US008240654B2

(12) United States Patent
Asami et al.

(10) Patent No.: US 8,240,654 B2
(45) Date of Patent: Aug. 14, 2012

(54) SPINE FORMATION DEVICE, POST-PROCESSING APPARATUS, AND SPINE FORMATION SYSTEM

(75) Inventors: Shinji Asami, Machida (JP); Nobuyoshi Suzuki, Tokyo (JP); Naohiro Kikkawa, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 106 days.

(21) Appl. No.: 12/801,144

(22) Filed: May 25, 2010

(65) Prior Publication Data

US 2010/0303585 A1 Dec. 2, 2010

(30) Foreign Application Priority Data

Jun. 1, 2009 (JP) ..... 2009-132454
Jan. 29, 2010 (JP) ..... 2010-018767

(51) Int. Cl.
*B31F 1/08* (2006.01)

(52) U.S. Cl. ..... 270/45; 270/32; 270/37; 270/58.07; 270/58.08

(58) Field of Classification Search ..... 270/32, 270/37, 45, 58.07, 58.08, 58.11; 412/22, 412/23
See application file for complete search history.

(56) References Cited

U.S. PATENT DOCUMENTS 5,320,336 A 6/1994 Asami
5,570,877 A 11/1996 Asami et al.
5,655,765 A 8/1997 Asami et al.
5,788,229 A 8/1998 Asami et al.
7,325,799 B2 * 2/2008 Watkiss ..... 270/39.08
7,328,892 B2 2/2008 Asami et al.
7,594,645 B2 * 9/2009 Suzuki et al. ..... 270/37
7,631,860 B2 12/2009 Asami et al.
2003/0031532 A1 * 2/2003 Nolte et al. ..... 412/33
2004/0126163 A1 7/2004 Asami et al.
2005/0189689 A1 9/2005 Kushida et al.
2007/0182082 A1 8/2007 Asami et al.
2010/0239393 A1 9/2010 Suzuki et al.
2010/0258994 A1 10/2010 Kikkawa et al.

FOREIGN PATENT DOCUMENTS

JP 2001-260564 9/2001
JP 2003-182928 7/2003
JP 2004-209886 7/2004
JP 2007237562 A * 9/2007
WO WO 2010/013440 2/2010

OTHER PUBLICATIONS

European Search Report dated Jan. 21, 2011 issued in corresponding European Application No. 10250975.9.

* cited by examiner

*Primary Examiner* — Leslie A Nicholson, III
(74) *Attorney, Agent, or Firm* — Harness, Dickey & Pierce, P.L.C.

(57) ABSTRACT

An spine formation device includes a sheet conveyer to transport a bundle of folded sheets with a folded portion of the bundle of folded sheets forming a front end portion, a sandwiching member to sandwich and squeeze the bundle of folded sheets in a direction of thickness of the bundle of folded sheets, and a spine formation unit disposed downstream from the sandwiching member in the sheet conveyance direction, to flatten the folded portion of the bundle of folded sheets held by the sandwiching member. The spine formation unit presses the folded portion of the bundle of folded sheets projecting a predetermined length from the sandwiching member in the sheet conveyance direction in a reverse direction of the sheet conveyance direction while moving in a direction perpendicular to a longitudinal direction of the folded portion of the bundle of folded sheets.

13 Claims, 11 Drawing Sheets

SPINE FORMATION DEVICE, POST-PROCESSING APPARATUS, AND SPINE FORMATION SYSTEM

CROSS-REFERENCE TO RELATED APPLICATIONS

This patent specification is based on and claims priority from Japanese Patent Application Nos. 2009-132454, filed on Jun. 1, 2009, and 2010-018767, filed on Jan. 29, 2010, in the Japan Patent Office, the contents of which are hereby incorporated by reference herein in their entirety.

BACKGROUND OF THE INVENTION

1. Field of the Invention

The present invention generally relates to a spine formation device to form a spine of a bundle of folded sheets, a post-processing apparatus including the spine formation device, and a spine formation system including the spine formation device, and an image forming apparatus, such as a copier, a printer, a facsimile machine, or a multifunction machine capable of at least two of these functions.

2. Discussion of the Background Art

Post-processing apparatuses to perform post processing of recording media, such as aligning, sorting, stapling, punching, and folding of sheets, are widely used and are often disposed downstream from an image forming apparatus to perform post-processing of the sheets output from the image forming apparatus. At present, post-processing apparatuses generally perform saddle-stitching along a centerline of sheets in addition to conventional edge-stitching along an edge portion of sheets.

To improve the quality of the finished product, several approaches, described below, for shaping the folded portion of a bundle of saddle-stitched sheets have been proposed. More specifically, when a bundle of sheets (hereinafter "booklet") is saddle-stitched and then folded in two, its folded portion, that is, a portion around its spine, tends to bulge, degrading the overall appearance of the booklet. In addition, because the bulging spine makes the booklet thicker on the spine side and thinner on the opposite side, when the booklets are piled together with the bulging spines on the same side, the piled booklets tilt more as the number of the booklets increases. Consequently, the booklets might fall over when piled together.

By contrast, when the spine of the booklet is flattened, bulging of the booklet can be reduced, and accordingly multiple booklets can be piled together. This flattening is important for ease of storage and transport because it is difficult to stack booklets together if their spines bulge, making it difficult to store or carry them. With this reformation, a relatively large number of booklets can be piled together.

The bulging spine of the booklet can, for example, be flattened using a pressing member configured to sandwich the portion adjacent to the spine of the booklet and a spine-forming roller configured to roll along that side of the pressing member from which the spine of the booklet protrudes in a longitudinal direction of the spine of the booklet while contacting the spine of the booklet. The spine-forming roller moves at least once over the entire length of the spine of the booklet being fixed by the pressing member while applying to the spine a pressure sufficient to flatten the spine.

However, because only the bulging portion is pressed with the spine-forming roller in this approach, the booklet can wrinkle in a direction perpendicular to the longitudinal direction in which the spine extends, degrading its appearance. In addition, with large sheet sizes, productivity decreases because it takes longer for the spine-forming roller to move over the entire length of the spine of the booklet.

Alternatively, a center portion of the saddle-stitched booklet in a direction in which the booklet is transported (hereinafter "sheet conveyance direction") may be pushed with a folding plate so that the booklet is sandwiched between a first pair of rollers, thereby forming the spine. With the booklet kept at a predetermined position, a second pair of rollers that move in a direction perpendicular to the sheet conveyance direction presses the folded portion from the side. In this approach, differently from the above-described approach, not the spine in parallel to a thickness direction of the booklet but the portion perpendicular to the spine is pressed, thus increasing the pressure per unit length. As a result, the spine can be shaped better, improving the quality of the booklet.

Although this approach can reduce the damage to the booklet caused by the first method described above, when the number of sheets forming the booklet increases, the folded portion curves gradually from the corners because multiple sheets form a multilayered structure. This phenomenon is particularly noticeable on sheets closer to the front cover. Thus, it is difficult to eliminate bulging of the spine.

In view of the foregoing, the inventors of the present invention recognize that there is a need to reduce bulging of booklets while maintaining productivity so that multiple booklets can be piled together, which known approaches fail to do.

SUMMARY OF THE INVENTION

In view of the foregoing, in one illustrative embodiment of the present invention provides a spine formation device to flatten a spine of a bundle of folded sheets. The spine formation device includes a sheet conveyer that conveys the bundle of folded sheets with a folded portion of the bundle of folded sheets forming a front end portion of the bundle of folded sheets, a sandwiching member disposed downstream from the sheet conveyer in a sheet conveyance direction in which the sheet conveyer conveys the bundle of folded sheets, and a spine formation unit disposed downstream from the sandwiching member in the sheet conveyance direction, to flatten the folded portion of the bundle of folded sheets held by the sandwiching member. The sandwiching member squeezes the bundle of folded sheets sandwiched therein in a direction of thickness of the bundle of folded sheets. The bundle of folded sheets is set at a position where folded portion thereof projects by a predetermined length from the sandwiching member in the sheet conveyance direction, and the spine formation unit presses against the folded portion in a reverse direction of the sheet conveyance direction while moving in a direction perpendicular to a longitudinal direction of the folded portion of the bundle of folded sheets.

In another illustrative embodiment of the present invention, a post-processing apparatus includes a saddle-stapler to staple a bundle of sheets together along a centerline of the bundle, a folding unit to fold the bundle of sheets along the centerline of the bundle, and the spine formation device described above.

Yet in another illustrative embodiment of the present embodiment, a spine formation system includes an image forming apparatus, a post-processing apparatus to perform post processing of sheets transported from the image forming apparatus, and the spine formation device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
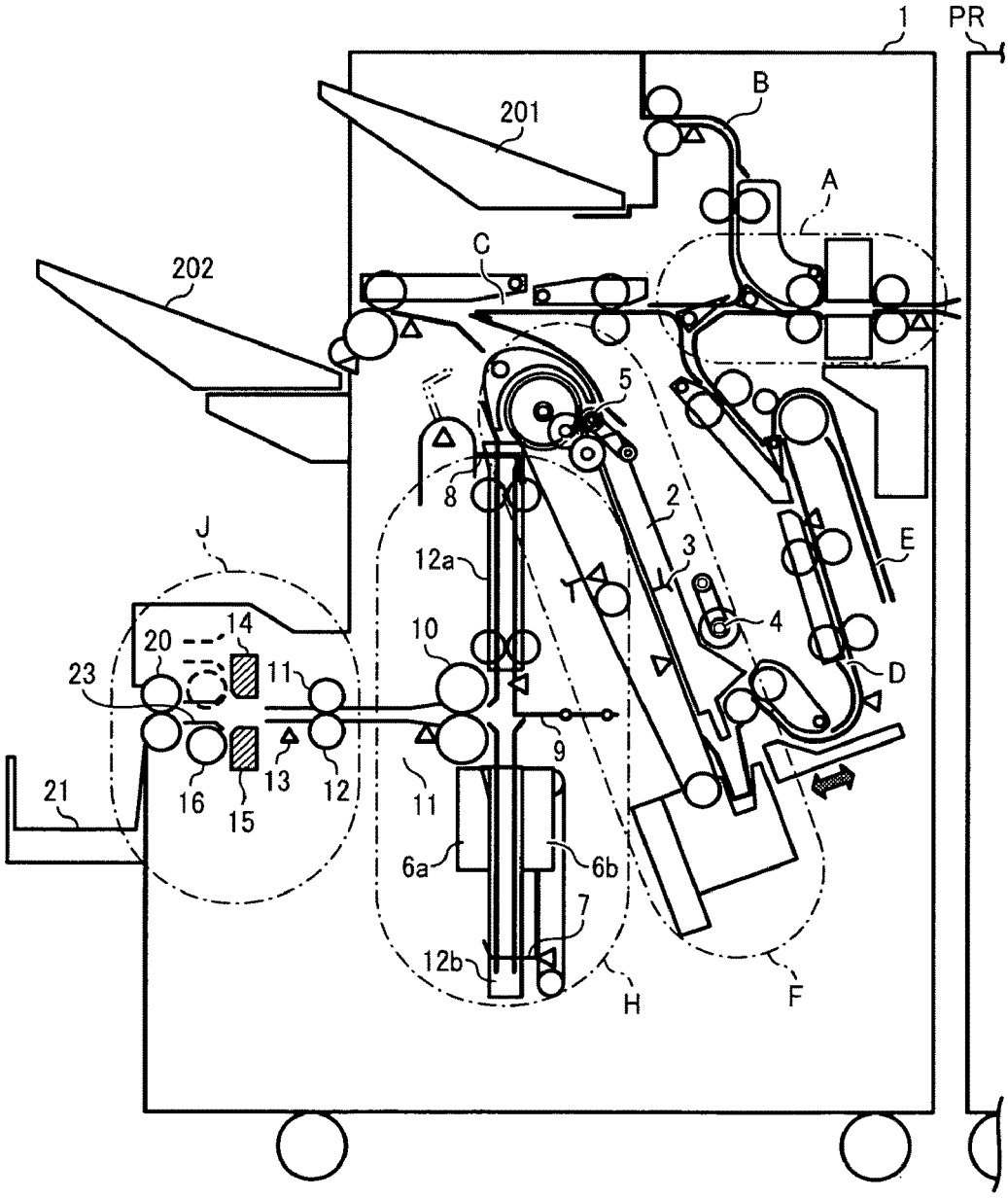
FIG. 1 illustrates a spine formation system including a post-processing apparatus and a spine formation device to flatten spines of booklets, according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a spine formation system according to an illustrative embodiment of the present invention is described.

It is to be noted that, in the description below, a pair of transport rollers 11 and 12 serve as a sheet conveyer, and first and second clamp members 14 and 15 serve as a sandwiching member. Further, a spine formation roller 16, an elevator unit 27 including a pressure spring 28, and the elevator motor 26 together form a spine formation unit.

FIG. 1 illustrates the spine formation system that includes a post-processing apparatus 1 and a spine formation device J to flatten or straighten spines of bundle of folded sheets.

The post-processing apparatus 1 includes an entrance path A along which sheets of recording media transported form an image forming apparatus PR to the post-processing apparatus 1 are initially transported, a transport path B leading from the entrance path A to a proof tray 201, a shift tray path C leading from the entrance path A to a shift tray 202, a transport path D leading from the entrance path A to a first processing tray F, a storage area E disposed along the transport path D, and a second processing tray H disposed downstream from the first processing tray F in a direction in which the sheet is transported (hereinafter "sheet conveyance direction"). The spine formation device J is connected to a downstream side of the post-processing apparatus 1 in the sheet conveyance direction. The first processing tray F aligns multiple sheets and staples an edge portion of the aligned multiple sheets as required. The multiple sheets processed on the first processing tray F are stored in the storage area E and then transported to the first processing tray F at a time. The sheets transported along the entrance path A or discharged from the first processing tray F are transported along the shift tray path C to the shift tray 202. The second processing tray H perform folding and/or saddle-stapling, that is, stapling along a centerline, of the multiple sheets aligned on the first processing tray F. Then, the spine formation device J flattens a folded edge (spine) of a bundle of sheets (booklet).

It is to be noted that the post-processing apparatus 1 has a known configuration and performs known operations, which are briefly described below.

The sheets transported to the post-processing apparatus 1 to be stapled along its centerline are stacked on the first processing tray F sequentially. A jogger fence 2 aligns the sheets placed on the first processing tray F in a width direction or transverse direction, which is perpendicular to the sheet conveyance direction. Further, a roller 4 pushes the sheets so that a trailing edge of the sheet contacts a back fence, not shown, disposed an upstream side in the sheet conveyance direction while a release belt, not shown, rotates in reverse so that a leading edge of the sheets is pressed against a back of a release pawl 3 disposed on a down stream side in the sheet conveyance direction, and thus a bundle of sheets are aligned in the sheet conveyance direction. After the sheets are aligned in the sheet conveyance direction as well as in the width direction, the release pawl 3 and a pressure roller 5 turn the bundle of sheets a relatively large angle along a guide roller, not shown, to the second processing tray H.

Then, the bundle of sheets is transported to a reference fence 7 on the second processing tray H, and a center stapling fences 12*a* and 12*b* align the sheets in the width direction. Further, the trailing edge of the bundle of sheets is pushed to an aligning pawl 8, and thus the sheets are aligned in the sheet conveyance direction. After the alignment, center staplers 6*a* and 6*b* staple the bundle of sheets along its centerline into a booklet as bookbinding. Then, the reference fence 7 pushes a center portion (folded position) of the booklet to a position facing a folding plate 9. The folding plate 9 moves horizontally in FIG. 1, which is perpendicular to the sheet conveyance direction, and a leading edge portion of the folding plate 9 pushes the folded position of the booklet between a pair of folding rollers 10, thereby folding the booklet. Then, the folding rollers 10 forward the folded booklet to the pair of transport rollers 11 and 12 of the spine formation device J.

It is to be noted that the spine formation device J may be configured as a spine formation unit removably attached to the post-processing apparatus 1. When the spine formation device J is configured to be removably attached to the post-processing apparatus 1, it is preferable that a pair of discharge rollers be provided along the sheet transport path between the folding rollers 10 to the transport rollers 11 and 12 of the spine formation device J. Alternatively, the spine formation device J may be integrated in or removably attached to the image forming apparatus PR similarly to the post-processing apparatus 1.

A configuration of the spine formation device J is described below with reference to FIGS. 1 and 2.

Figure 2:
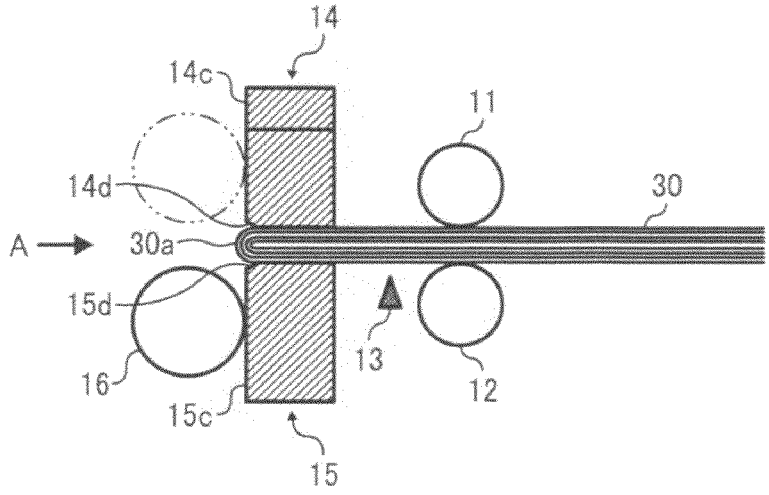
FIG. 2 is a front view of a main portion of the spine formation device shown in FIG. 1, schematically illustrating a configuration around first and second clamp members.

FIG. 2 is a front view of a main portion of the spine formation device J, schematically illustrating a configuration around the clamp members 14 and 15. In FIG. 2, reference numeral 30 represents a booklet formed by the multiple sheets bound together and then folded by the folding plate 9 and the folding rollers 10.

The spine formation device J includes the pair of transport rollers 11 and 12, the pair of clamp members 14 and 15 (e.g., a first clamp member 14 and a second clamp member 15), the spine formation roller 16, a pair of discharge rollers 20, and a discharge tray 21, which are disposed in that order along the sheet conveyance direction. An axis of rotation of the spine formation roller 16 parallels or substantially parallels a longitudinal direction of a folded portion 30*a* of a booklet 30. The spine formation roller 16 moves along guide surfaces 14*c* and 15*c* of the clamp members 14 and 15, respectively, on the downstream side in the sheet conveyance direction.

Additionally, guide plates 22 and 23, serving as a sheet guide, to guide the booklet 30 are provided above the spine formation roller 16 in FIG. 1, and a leading-edge detector 13 is provided downstream from the transport rollers 11 and 12 in the sheet conveyance direction to detect a leading-edge portion 30*a* (e.g., folded portion) of the booklet 30.

It is to be noted that, in FIG. 2, reference characters 14*d* and 15*d* respectively represent chamfered portions formed by chamfering the corners between the guide surfaces 14*c* and 15*d* and the surfaces facing the booklet 30 of the clamp members 14 and 15 over an entire length L1 (shown in FIG. 3) of the first clamp member 14 in the direction perpendicular to the surface of paper on which FIG. 2 is drawn.

Figure 3:
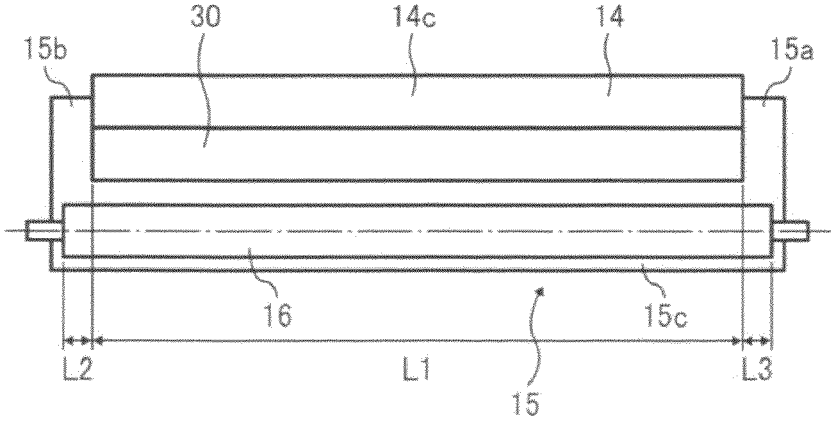
FIG. 3 is a side view of the spine formation device viewed in a direction indicated by arrow A shown in FIG. 2.

FIG. 3 is a side view of the spine formation device J viewed in a direction indicated by arrow A shown in FIG. 1.

The transport rollers 11 and 12 transport the booklet 30 sandwiched therebetween by rotating, and the folded portion forms a front end portion of the booklet 30. After the leading-edge detector 13 detects the leading-edge portion 30*a* of the booklet 30, the transport rollers 11 and 12 transport the booklet 30 to a predetermined position where the leading-edge portion 30*a* projects from the guide surfaces 14*c* and 15*c* of the clamp members 14 and 15 by a predetermined length (projection length d).

Figure 4:
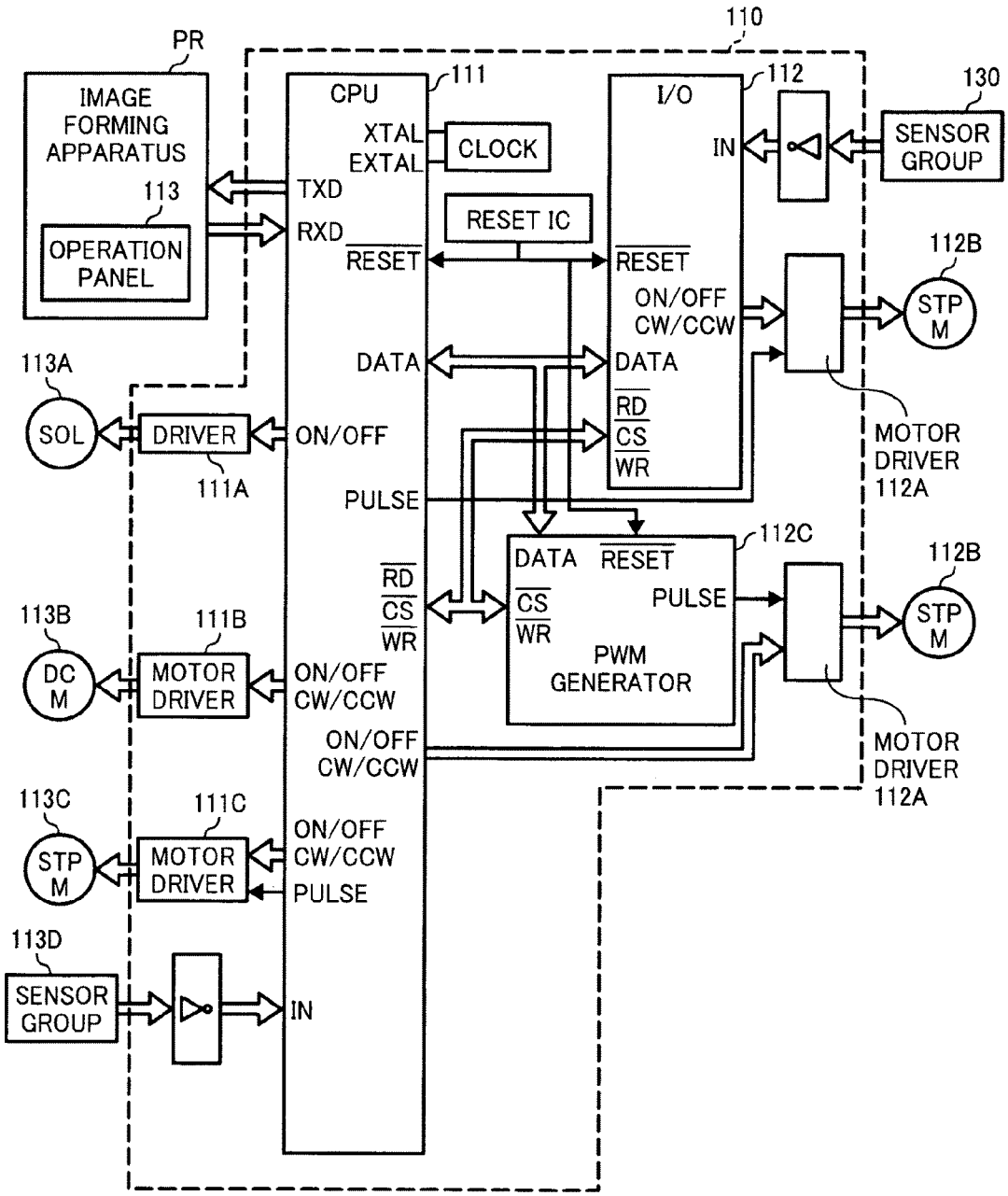
FIG. 4 is a schematic control block diagram of the spine formation system shown in FIG. 1.

The transport rollers 11 and 12 are driven by a motor, not shown, which is controlled by a central processing unit (CPU) 111 of a control circuit or control unit 110 shown in FIG. 4.

FIG. 4 is a control block diagram of the spine formation system shown in FIG. 1.

As shown in FIG. 4, the control circuit 110 incorporates a micro computer including the CPU 111 and an input/output (I/O) interface 112. In the control circuit 110, the CPU 111 performs various types of control according to signals received via the I/O interface 112 from respective switches in an operation panel 113 of the image forming apparatus PR, a sensor group 130 including various sensors and detectors. The CPU 111 reads out program codes stored in a read only memory (ROM), not shown, and performs various types of control based on the programs defined by the program codes using a random access memory (RAM), not shown, as a work area and data buffer. The control circuit 110 includes drivers 111A, motor drivers 111B, 111C, and 112A, and a pulse module width (PWM) generator 112C, and communicates with stepping motors 112B, solenoids 113A, direct current (DC) motors 113B, stepping motors 113C, and sensor groups 113D.

The clamp members 14 and 15 can move closer to and away from each other and sandwich therebetween the booklet 30 that has transported to the predetermined position by the transport rollers 11 and 12, thereby fixing the position of the booklet 30. As a driving mechanism to move the clamp members 14 and 15, for example, a gear deceleration mechanism or a hydraulic driving mechanism can be used although not shown in figures.

Referring to FIG. 3, the length L1 of the first clamp member 14 in the sheet width direction is greater than the maximum sheet size, that is, the maximum width of sheets that the spine formation device J accommodates, and the second clamp member 15 has a width greater than the length L1 of the first clamp member 14 and includes guide portions 15*a* and 15*b* on both ends in the sheet width direction to guide the spine formation roller 16.

The spine formation roller 16 deforms, that is, flattens the leading-edge portion or folded portion 30*a* of the booklet 30 to shape it into the spine of the booklet 30. As shown in FIG. 3, both end portions in the sheet width direction of the circumferential surface of the spine formation roller 16 are respectively pressed against the guide portions 15*a* and 15*b* of the second clamp member 15. While rotating on the guide surfaces 14*c* and 15*c* of the clamp members 14 and 15 in this state, the spine formation roller 16 presses to flatten the leading-edge portion 30*a* of the booklet 30 that projects from the guide surfaces 14*c* and 15*c* by the predetermined length and is sandwiched between the clamp members 14 and 15 with a predetermined or given pressure in a reverse direction of the sheet conveyance direction. Thus, the folded portion 30*a* is shaped into a flat spine with bulging of the portions adjacent to the folded portion 30*a* prevented or reduced.

When pressed against the spine formation roller 16, the folded portion 30*a* can escape to the chamfered portions 14*d* and 15*d*, that is, the chamfered portions 14*d* and 15*d* can accommodate the portion extended in the thickness direction of the booklet 30 due to flattening. As shown in FIG. 3, the spine formation roller 16 is longer than the length L1 by lengths L2 and L3 on the respective sides, and its both end portions corresponding to the lengths L2 and L3 rotates pressingly on the guide portions 15*a* and 15*b* even when its center portion is in contact with the folded portion 30*a* of the booklet 30.

It is to be noted that, in FIG. 3, the portion of the booklet 30 sandwiched between the first and second clamp members 14 and 15 is the folded portion 30*a*, which is pressed against the center portion of the spine formation roller 16 corresponding to the length L1.

With this configuration, regardless of steps formed by the first and second clamp members 14 and 15, the spine formation roller 16 can flatten the folded portion 30*a* projecting from the first and second clamp members 14 and 15 by the predetermined projection length (projection length d in FIG. 5B) reliably and precisely. It is to be noted that, although relatively large steps are created due to the gap between the clamp members 14 and 15 when the number of sheets is relatively large, adverse effects of the steps can be eliminated by holding the booklet 30 securely with the claim members 14 and 15 and by setting the projection length d of the leading-edge portion 30*a* from the guide surfaces 14*c* and 15*c* according to the thickness of the booklet 30.

FIGS. 5A through 5D illustrate processes of shaping the leading-edge portion 30*a* into a square spine.

Figure 5A:
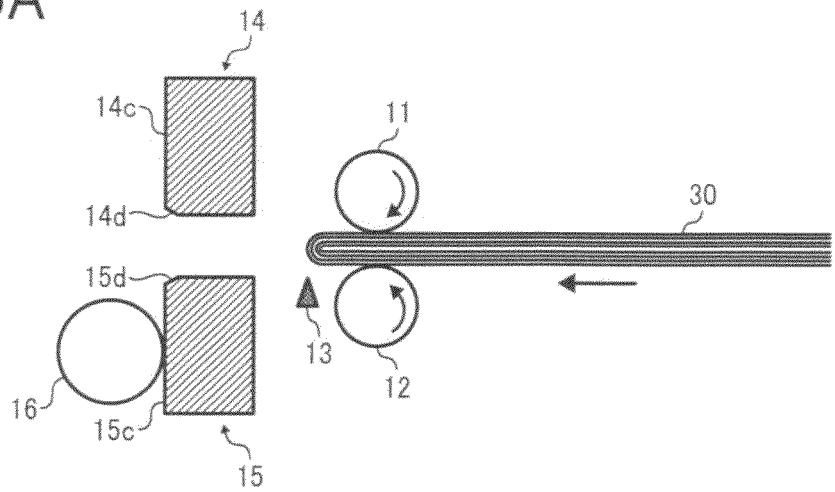
FIGS. 5A through 5E illustrate processes of shaping a folded leading-edge portion of a booklet into a square spine.

Referring to FIG. 5A, the transport rollers 11 and 12 transport the booklet 30, folded by the folding plate 9 and the folding roller 10 in a preceding stage, to the clamp members 14 and 15. In the course of transportation, the leading-edge detector 13 detects the folded leading-edge portion 30*a* of the booklet 30, and the CPU 111 of the control circuit 110 acquires the timing when the leading-edge portion 30*a* passes the position where the leading-edge detector 13 is disposed.

Figure 5B:
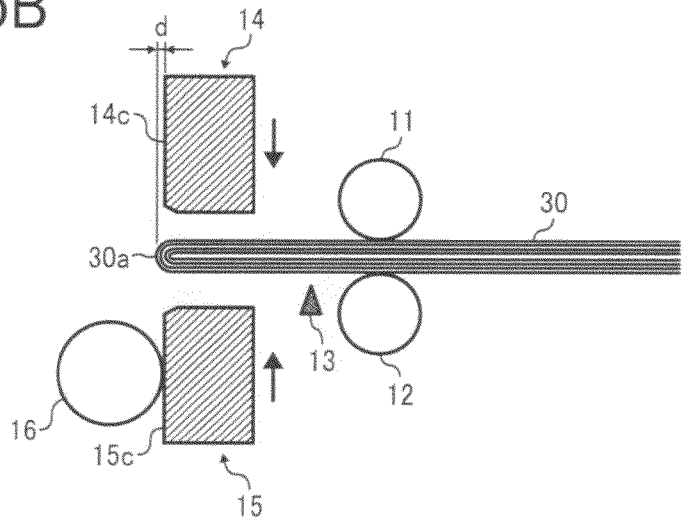

Referring to FIG. 5B, based on this timing and the transporting velocity (linear velocity) of the transport rollers 11 and 12, the transport rollers 11 and 12 stop transporting the booklet 30 when the leading-edge portion 30*a* projects from the guide surfaces 14*c* and 15*c* by the predetermined length d.

Figure 5C:
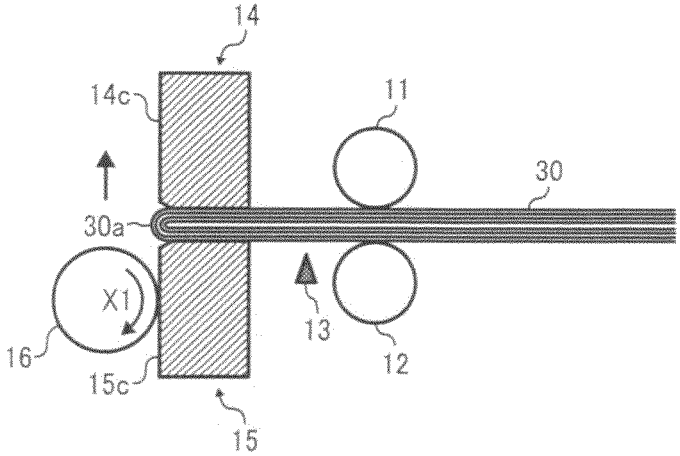

In this state, as shown in FIG. 5C, the driving mechanism, not shown, causes the clamp members 14 and 15 to approach each other to hold the booklet 30 with a predetermined pressure. Thus, the leading-edge portion 30*a* of the booklet 30 is fixed at the position where the leading-edge portion 30*a* projects from the guide surfaces 14*c* and 15*c* by the predetermined length d. In this state, the spine formation roller 16 positioned closer to the second clamp member 15 rotates in a direction indicated by arrow X1. As the spine formation roller 16 is pressed against the guide surface 15*c* with a predetermined pressure, the spine formation roller 16 moves upward in FIG. 5C. Then, the spine formation roller 16 moves on the leading-edge portion 30*a*, shaping it into a square spine. At that time, the leading-edge portion 30*a* is deformed, that is, flattened, by the pressure applied from the spine formation roller 16.

It is to be noted that the predetermined projection length d is set according to the number of sheets bundled together, which is described later with reference to FIG. 8.

Figure 5D:
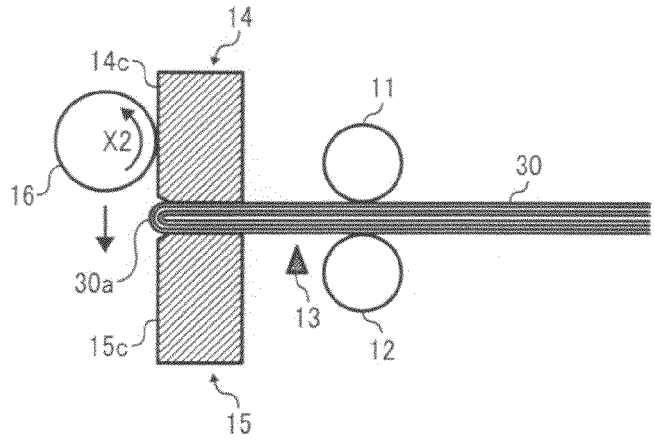
Figure 5E:
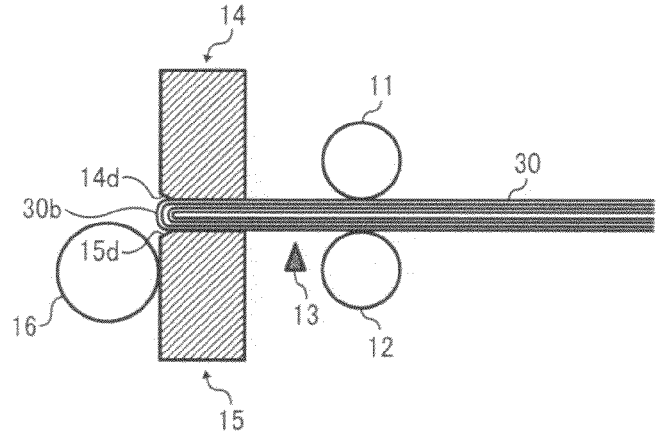

When the spine formation roller 16 has passed the leading-edge portion 30*a* of the booklet 30 and reaches a position shown in FIG. 5D, the spine formation roller 16 rotates in reverse, that is, in a direction indicated by arrow X2, and moves downward in FIG. 5D, thus passing the leading-edge portion 30*a* again. Then, due to effects similar to those in the process shown in FIG. 5C, the leading-edge portion 30*a* is further deformed. As a result, as shown in FIG. 5E, the leading-edge portion 30*a* of the booklet 30 can be pressed to be leveled with the guide surfaces 14*c* and 15*c* of the clamp members 14 and 15 and thus flattened. This flattening shapes the leading-edge portion 30*a* into a spine 30*b* shown in FIG. 5E, and the folded lines of the leading-edge portion 30*a* can be more secure. At that time, because the clamp members 14 and 15 hold the portion adjacent to the leading edge portion 30*a* with a given pressure, this portion does not bulge and the spine 30*b* can be symmetrical on the front side and on the back side of the booklet 30.

It is to be noted that, if the leading-edge portion 30*a* is not flattened sufficiently, the spine formation roller 16 can reciprocate across the leading-edge portion 30*a* multiple times until the leading-edge portion 30*a* is fully flattened. To facilitate flattening of the spine, as described above, the chamfered portions 14*d* and 15*d* are formed on the downstream corners of the clamp members 14 and 15 in the sheet conveyance direction, and overflowing portions in the thickness direction can escape to the chamfered portions 14*d* and 15*d*. Thus, the leading-edge portion 30*a* can be flattened and serve as the spine of the booklet 30. After the spine formation, the discharge rollers 20 discharge the booklet 30 onto the discharge tray 21.

It is to be noted that the number of reciprocal movements (hereinafter "reciprocation number") of the spine formation roller 16, that is, how many times the spine formation roller 16 moves back and forth, can be set according to one of multiple predetermined variables relating to the booklet 30, such as, the number of sheets, the thickness of the booklet 30, direction of grain of sheets, rigidity of sheets, and the like.

Additionally, because the spine formation roller 16 moves up and down in FIGS. 5A through 5E, a space through which the spine formation roller 16 moves is required between the discharge rollers 20 and the clamp members 14 and 15. Therefore, as shown in FIG. 6; which schematically illustrates a main portion of the spine formation device J around the spine formation roller 16, in the present embodiment, the guide plates 22 and 23 are provided between the clamp members 14 and 15 and the discharge rollers 20 to guide the booklet 30 to the discharge rollers 20 when the spine formation roller 16 is at the standby position, thus attaining reliably transport of the booklet 30.

Figure 6:
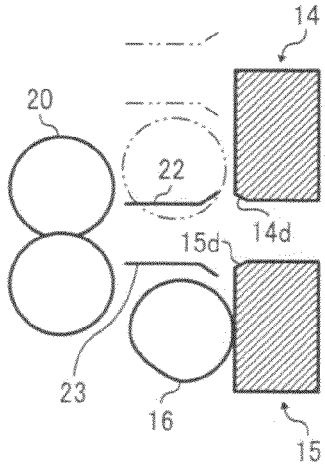
FIG. 6 is a front view of a main portion of the spine formation device shown in FIG. 1, schematically illustrating a configuration around a pine formation roller.

It is to be noted that, as shown in FIG. 6, the guide plates 22 and 23 arranged vertically are connected or attached to the spine formation roller 16 and move together with the spine formation roller 16 in the spine formation. Needless to say, the guide plates 22 and 23 can serve as a guide member for the sheets also when spine formation by the spine formation roller 16 is not necessary.

Figure 7A:
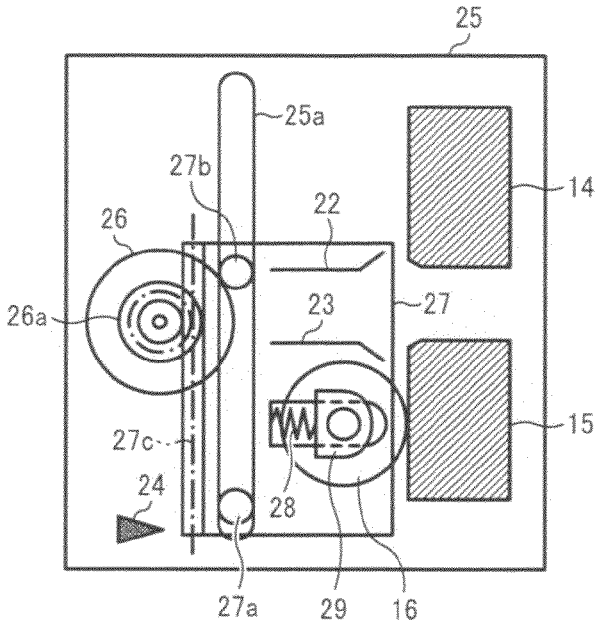
FIGS. 7A and 7B illustrate a mechanism including the first and second clamp members, to press against the folded portion of the booklet.
Figure 7B:
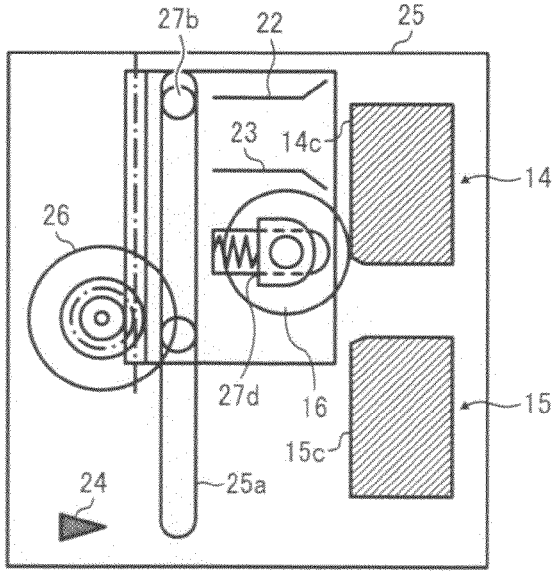

FIGS. 7A and 7B illustrate a press mechanism including the clamp members 14 and 15 shown in FIG. 6 to press against the leading-edge portion 30*a* of the booklet 30. FIG. 7A corresponds to FIG. 5C, and the spine formation roller 16 is positioned on a lower side, and FIG. 7B corresponds to FIG. 5D and the spine formation roller 16 is positioned on an upper side.

Referring to FIGS. 7A and 7B, the spine formation roller 16 and the guide plates 22 and 23 together form the elevator unit 27. It is to be noted that, although the guide plates 22 and 23 are planar members extending in the longitudinal direction of the spine formation roller 16 shown in FIG. 3 in the present embodiment, alternatively, multiple members having a predetermined or given relatively small width may be arranged in the longitudinal direction of the spine formation roller 16, above the elevator unit 27, and be configured to move together with the spine formation roller 16 vertically in FIGS. 7A and 7*b*.

The elevator unit 27 includes a pair of rollers 27*a* and 27*b* disposed in a lower end portion and an upper end portion of the elevator unit 27, respectively, and the rollers 27*a* and 27*b* project from both the front side and the back side of the elevator unit 27. The rollers 27*a* and 27*b* movably engage a slot 25*a* formed in a front plate and a back plate of a frame 25 of the spine formation device J. With this configuration, the elevator unit 27 can descend and ascend along a predetermined path, guided by the slot 25*a*. The elevator unit 27 further includes a rack 27*c* disposed on an edge surface in parallel to the slot 25*a*, opposite the side where the spine formation roller 16 is disposed, and a gear 26*a* attached to an output shaft of the elevator motor 26 engages the rack 27*c*. With this configuration, rotation of the gear 26*a* is converted to a linear movement of the rack 27*c* so that the elevator unit 27 can move vertically in FIGS. 7A and 7B.

A home position of the elevator unit 27 is set to a position where the guide plates 22 and 23 corresponds to the gap between the clamp members 14 and 15 so that the guide plates 22 and 23 can guide the booklet 30 discharged from the clamp members 14 and 15. In FIGS. 7A and 7B, the home position of the elevator unit 27 is a lower portion of the spine formation device J. A home position (HP) sensor 24 disposed in the lower portion detects a lower end portion of the elevator unit 27, thereby detecting that the elevator unit 27 is at the home position used as a reference in control of the vertical movement of the elevator unit 27. In other words, rotation amount of the elevator motor 26 is set with the driving pulse determined with reference to the position detected by the HP sensor 24. The elevator motor 26 can be a stepping motor or a DC motor with an encoder. It is to be noted that the CPU 111 of the control circuit 110 control the vertical movement of the elevator unit 27.

Additionally, although the pressure spring 28 shown in FIG. 7A elastically biases the spine formation roller 16 to the clamp members 14 and 15 constantly so that the spine formation roller 16 moves on the clamp members 14 and 15 and presses against the leading-edge portion 30*a* of the booklet 30 in this state, the pressing force exerted by the spine formation roller 16 is increased from an initial set value due to the projection length d, and the force to press against the leading-edge portion 30*a* is increased accordingly. Additionally, as shown in FIG. 7B, a guide groove 27*d*, extending in a direction perpendicular to the guide surfaces 14*c* and 15*c* of the clamp members 14 and 15, is formed in the elevator unit 27. A bearing 29 slidingly engages the guide groove 27*d* and rotatably supports the spine formation roller 16, and thus the spine formation roller 16 can move in the direction perpendicular to the guide surfaces 14*c* and 15*c* of the clamp members 14 and 15 in accordance with the projection length d of the leading-edge portion 30*a*.

Figure 8:
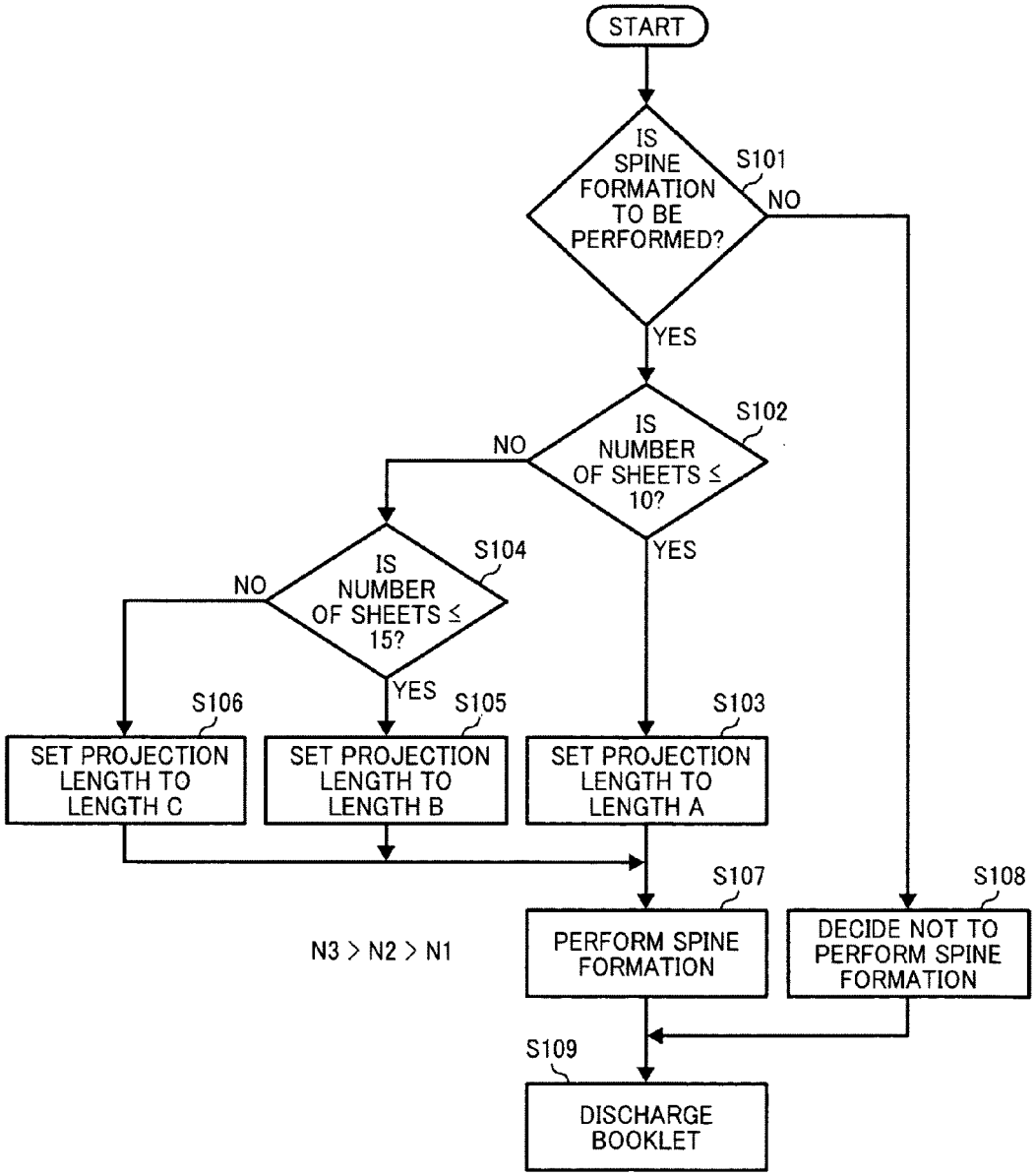
FIG. 8 is a flowchart of a procedure of setting a predetermined projection length according to the number of sheets included in the booklet and forming the spine of the booklet.

FIG. 8 illustrates a procedure of setting the predetermined projection length d according to the number of sheets included in the booklet and forming the spine of the booklet.

As shown in FIG. 8, when saddle-stitching or saddle-stapling and center-folding are performed, at S101 the control unit 110 shown in FIG. 4 checks whether or not spine formation is to be performed. When spine formation is to be performed, the control unit 110 checks whether the number of sheets included in the booklet 30 is within 10 (e.g., a first predetermined number) at S102, within 15 (e.g., a second predetermined number) at S104, and greater than 15. When the number of sheets is within 10 (YES at S102), at S103 the control unit 110 sets the projection length d to a first projection length A. When the number of sheets is within 15 (YES at S104), at S105 the control unit 110 sets the projection length d to a second projection length B. When the number of sheets is 16 or greater (NO at S104), at S106 the control unit 110 sets the projection length d to a third projection length C. Then, at S107 the control unit 110 causes the spine formation roller 16 to rotate, thereby forming the spine of the booklet 30, and at S109 the booklet 30 is discharged. By contrast, when the spine formation is not to be performed (NO at S101), spine formation is not performed at S108 and then the booklet 30 is discharged at S109.

Figure 9:
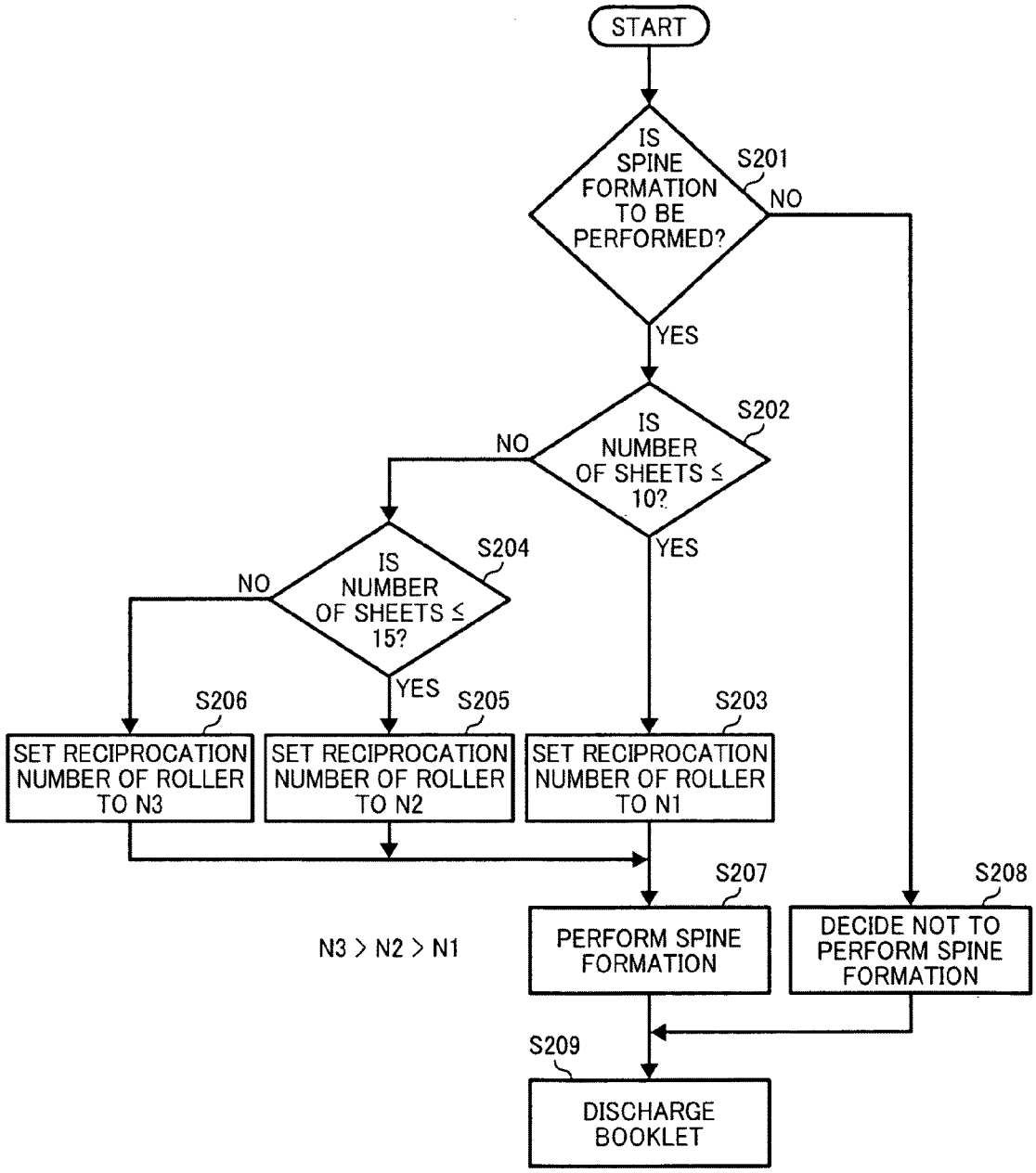
FIG. 9 is a flowchart illustrating a procedure of spine formation in which the number of reciprocal movements of the spine formation roller is set according to the number of sheets.

FIG. 9 is a flowchart illustrating a procedure of spine formation in which the reciprocation number of the spine formation roller 16 is set according to the number of sheets.

In FIG. 9, operations performed in steps S201, S202, and S204 are similar to those performed in steps S101, S102, and S104 in the procedure shown in FIG. 8, and the procedure is bifurcated into three different cases based on the number of sheets, within 10, greater than 10 and up to 15, and greater than 15, respectively. When the number of sheets is within the first predetermined number, for example, 10 (YES at S202), at S203 the control unit 110 sets the reciprocation number of the spine formation roller 16 to a first number N1. When the number of sheets is greater than the first predetermined number, up to the second predetermined number, for example, form 11 to 15 (YES at S204), at S205 the control unit 110 sets the reciprocation number of the spine formation roller 16 to a second number N2. When the number of sheets is greater than the second predetermined number, that is, 16 or greater (NO at S204), at S206 the control unit 110 sets the reciprocation number of the spine formation roller 16 to a third number N3. Then, at S207 the spine formation is performed and at S209 the booklet 30 is discharged. By contrast, when the spine formation is not to be performed (NO at S201), spine formation is not performed at S208 and then the booklet 30 is discharged at S209.

Figure 10:
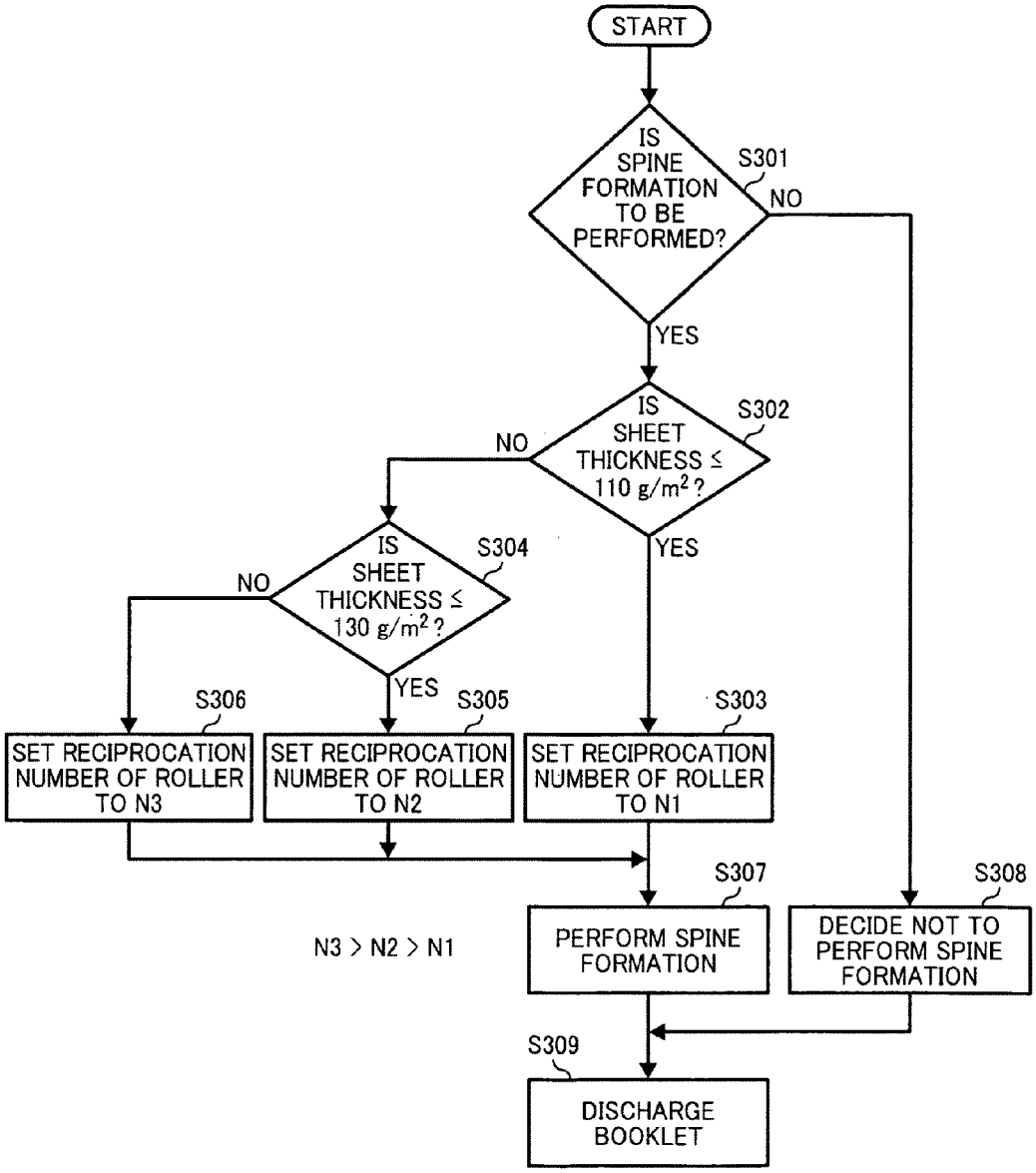
FIG. 10 is a flowchart illustrating a procedure of spine formation in which the number of reciprocal movements of the spine formation roller is set according to the thickness of the booklet.

FIG. 10 is a flowchart illustrating a procedure of spine formation in which the reciprocation number of the spine formation roller 16 is set according to the thickness of sheets.

In FIG. 10, at steps S302 and S304, the procedure is bifurcated into three different cases based on sheet thickness, which can be defined as the unit weight of sheets. Although sheet weights of 110 g/m$^2$ and 130 g/m$^2$ are used as examples of standard sheets and thicker sheets in the procedure shown in FIG. 10, sheets processed by the spine formation device J are not limited thereto.

At S302, when the sheets of the booklet 30 are thinner sheets, for example, sheets having a unit weight of 110 g/m$^2$ or less (YES at S302), at S303 the control unit 110 sets the reciprocation number of the spine formation roller 16 to a first number N1. When the sheets of the booklet 30 are standard sheets, for example, sheets having a weight within a range from 110 g/m$^2$ to 130 g/m$^2$, (YES at S304), at S305 the control unit 110 sets the reciprocation number of the spine formation roller 16 to the second number N2. When the sheets of the booklet 30 are thicker sheets, for example, sheets having a weight greater than 130 g/m$^2$, at S306 the control unit 110 sets the reciprocation number of the spine formation roller 16 to the third number N3. Then, at S307 the spine formation is performed and at S309 the booklet 30 is discharged. By contrast, when the spine formation is not to be performed (NO at S301), spine formation is not performed at S308 and then the booklet 30 is discharged at S309.

Figure 11:
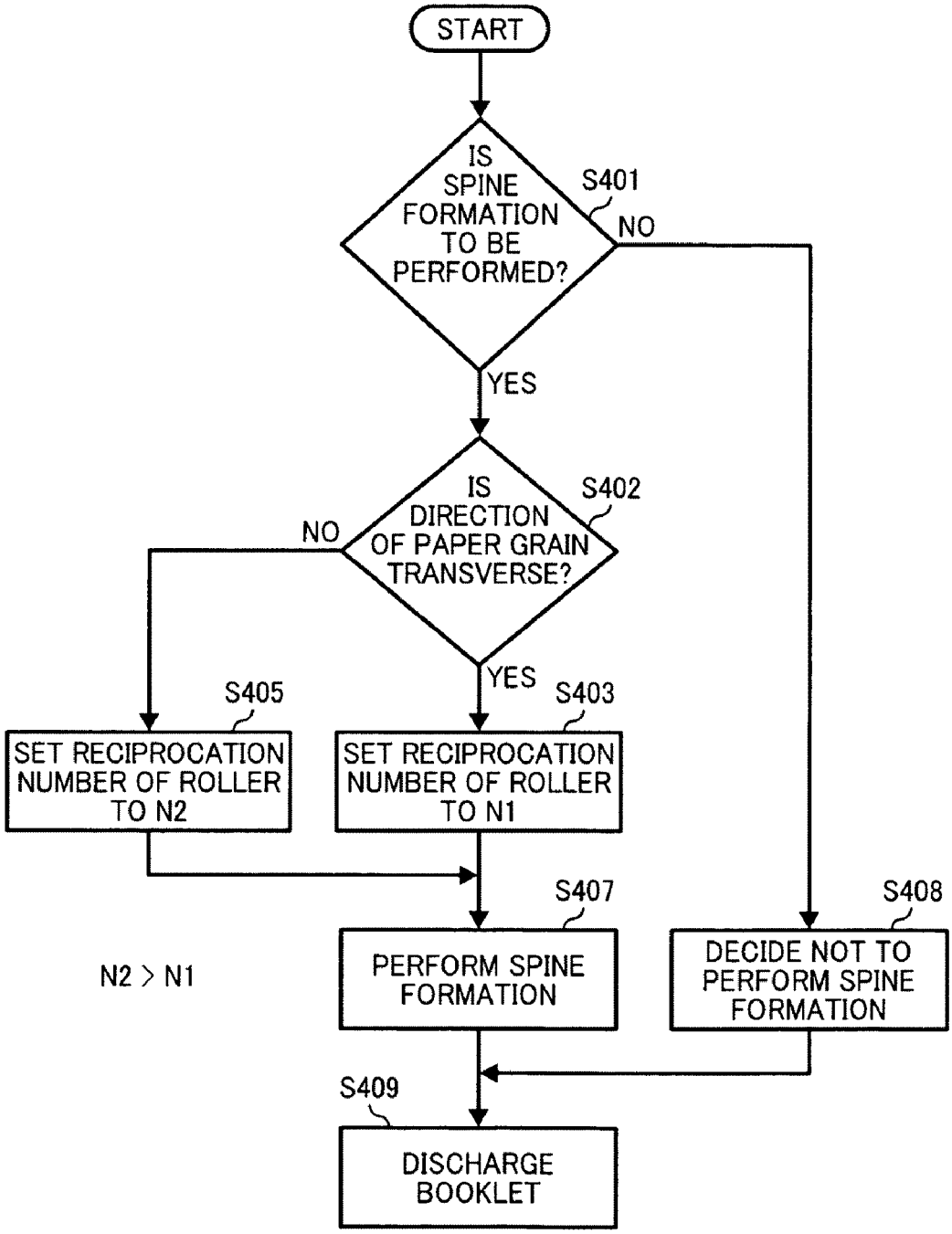
FIG. 11 is a flowchart illustrating a procedure of spine formation in which the number of reciprocal movements of the spine formation roller is set according to the direction of grain of sheets.

FIG. 11 is a flowchart illustrating a procedure of spine formation in which the reciprocation number of the spine formation roller 16 is set according to the direction of grain of sheets.

In FIG. 11, operations performed at steps S401 and S407 through S409 are similar to those performed in FIG. 8. When the spine formation is to be performed (YES at S401), at S402 whether the direction of grain of sheets is transverse or longitudinal is checked. The reciprocation number of the spine formation roller 16 is set to the first number N1 at S403 when the direction of grain of sheets is transverse (YES at S402) and to the second number N2 at S405 when the direction of grain of sheets is longitudinal (NO at S402). Then, at S407 the spine formation is performed and at S409 the booklet 30 is discharged.

Figure 12:
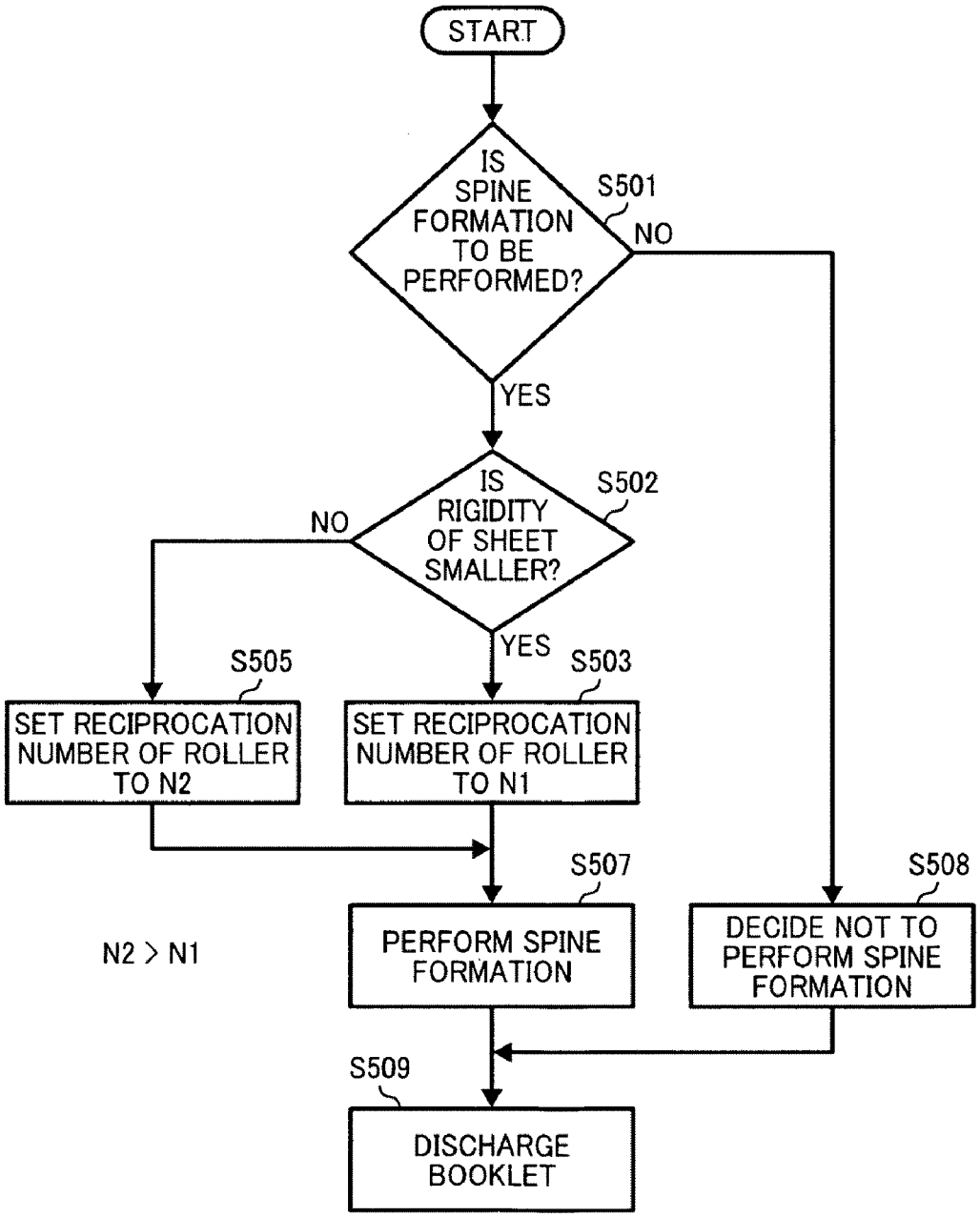
FIG. 12 is a flowchart illustrating a procedure of spine formation in which the number of reciprocal movements of the spine formation roller is set according to the degree of rigidity of sheets.

FIG. 12 is a flowchart illustrating a procedure of spine formation in which the reciprocation number of the spine formation roller 16 is set according to the rigidity of sheets.

In FIG. 12, operations performed at steps S501 and S507 through S509 are similar to those performed in FIG. 8. When the spine formation is to be performed (YES at S501), at S502 whether the degree of rigidity of sheets is relatively small or large is checked. The reciprocation number of the spine formation roller 16 is set to the first number N1 at S503 when the degree of rigidity of sheets is smaller (YES at S502) and to the second number N2 at S505 when the degree of rigidity of sheets is larger (NO at S502). Then, at S507 the spine formation is performed and at S509 the booklet 30 is discharged.

It is to be noted that rigidity of sheets can be quantified through, for example, folding tests of the sheets, and reference degrees of rigidity used in the present embodiment can be set experimentally.

Regarding the predetermined projection lengths A, B, and C, A<B<C is satisfied, and regarding the reciprocation numbers N1, N2, and N3, N1<N2<N3 is satisfied. Actual projection lengths and actual reciprocation numbers can be set experimentally for each device.

Thus, in an illustrative embodiment, the spine formation device J includes a pair of transport rollers 11 and 12 to transport the booklet 30 with the folded portion on the front side or leading side, the first and second clamp members 14 and 15 to sandwich and squeeze the booklet 30 in the direction of thickness of the booklet 30, and the elevator unit 27 including the spine formation roller 16 to flatten the leading-edge portion 30*a*, thereby forming the spine of the booklet 30. The transport rollers 11 and 12 transport the booklet 30 to a position where the leading-edge portion 30*a* projects from the clamp members 14 and 15 by a predetermined projection length d, and the spine formation roller 16 moves in the direction perpendicular to the longitudinal direction of the leading-edge portion 30*a* held at that position. While thus rotating, the spine formation roller 16 presses against the leading-edge portion 30*a* to the upstream side in the direction in which the booklet 30 is transported.

As described above, in the present embodiment, a portion around the leading-edge of the booklet 30 is sandwiched by the clamp members 14 and 15, and the spine formation roller 16 having a shaft parallel to the leading-edge portion 30*a* (folded portion) of the booklet 30 moves in a direction perpendicular to the longitudinal direction of the leading-edge portion 30*a*, thereby pressing the leading-edge portion 30*a*. Therefore, the spine of the booklet 30 can be flattened in a shorter time. At that time, because the clamp members 14 and 15 sandwich the leading-edge portion 30*a* therebetween with a predetermined pressure, bulging of the portion around the leading-edge portion 30*a* can be prevented.

Additionally, because the chamfered portions 14*d* and 15*d* can accommodate the portions of the leading-edge portion 30*a* overflowing to the front side and the back side of the booklet 30 due to flattening, the leading-edge portion 30*a* can become flat relatively easily and reliably. Thus, a booklet with a square spine can be produced, and many booklets can be piled together because bulging of the booklet is reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device comprising:

a sheet conveyer that conveys a bundle of folded sheets with a folded portion of the bundle of folded sheets forming a front end portion of the bundle of folded sheets;

a sandwiching member disposed downstream from the sheet conveyer in a sheet conveyance direction in which the sheet conveyer conveys the bundle of folded sheets, the sandwiching member to sandwich and squeeze the bundle of folded sheets, in a direction of thickness of the bundle of folded sheets; and a spine formation unit disposed downstream from the sandwiching member in the sheet conveyance direction, to flatten the folded portion of the bundle of folded sheets held by the sandwiching member, the folded portion of the bundle of folded sheets projecting a predetermined length from the sandwiching member in the sheet conveyance direction, the spine formation unit pressing against the folded portion of the bundle of folded sheets in a reverse direction of the sheet conveyance direction while moving in a direction perpendicular to both the sheet conveyance direction and a longitudinal direction of the folded portion of the bundle of folded sheets.

2. The spine formation device according to claim 1, wherein the spine formation unit moves reciprocally back and forth at least once in the direction perpendicular to the longitudinal direction of the folded portion of the bundle of folded sheets.

3. The spine formation device according to claim 2, wherein the number of reciprocal movements of the spine formation unit is set according to one of a plurality of predetermined variables relating to the folded sheets.

4. The spine formation device according to claim 3, wherein the predetermined variables includes a number of the folded sheets, a thickness of the bundle of folded sheets, a direction of grain of the folded sheets, and a degree of rigidity of the folded sheets.

5. The spine formation device according to claim 1, wherein the spine formation unit comprises a spine formation roller having an axis of rotation disposed parallel to the longitudinal direction of the folded portion of the bundle of folded sheets, and the spine formation roller presses against the folded portion of the bundle of folded sheets while moving in the direction perpendicular to the longitudinal direction of the folded portion of the bundle of folded sheets.

6. The spine formation device according to claim 5, wherein the sandwiching member comprises a guide surface facing the spine formation roller, and the spine formation roller moves along the guide surface of the sandwiching member with a predetermined pressure.

7. The spine formation device according to claim 6, wherein the guide surface of the sandwiching member comprises guide portions disposed outside the folded portion of the bundle of folded sheets in the longitudinal direction of the folded portion of the bundle of folded sheets, and the guide portions receive pressure exerted by both end portions in an axial direction of the spine formation roller while the spine formation roller presses against the folded portion of the bundle of folded sheets.

8. The spine formation device according to claim 6, wherein the sandwiching member further comprises a chamfered portion disposed on a downstream corner between the guide surface and a surface facing the bundle of folded sheets in the sheet conveyance direction.

9. The spine formation device according to claim 5, wherein the sandwiching member comprises first and second halves disposed on both sides of the bundle of folded sheets in the direction of thickness of the bundle, each having a pressing face pressed against the bundle in the direction of thickness of the bundle and a guide surface facing the spine formation roller, and the spine formation roller sequentially rolls on the guide surface of the first half of the sandwiching member, the folded portion of the bundle, and the guide surface of the second half of the sandwiching member.

10. The spine formation device according to claim 1, wherein the predetermined length of the folded portion of the bundle of folded sheets projecting from the sandwiching member is set according to the number of the folded sheets.

11. The spine formation device according to claim 1, further comprising a sheet guide disposed downstream from the sandwiching member in the sheet conveyance direction, to guide the bundle of folded sheets discharged from the sandwiching member, and the sheet guide is connected to the spine formation unit and moves together with the spine formation unit.

12. A post-processing apparatus comprising:

a saddle-stapler to staple a bundle of sheets together along a centerline of the bundle;

a folding unit to fold the bundle of sheets along the centerline of the bundle; and a spine formation device to flatten a folded portion of the bundle of folded sheets, the spine formation device comprising:

a sheet conveyer that conveys the bundle of folded sheets with a folded portion of the bundle of folded sheets forming a front end portion of the bundle of folded sheets;

a sandwiching member disposed downstream from the sheet conveyer in a sheet conveyance direction in which the sheet conveyer conveys the bundle of folded sheets, the sandwiching member to sandwich and squeeze the bundle of folded sheets, in a direction of thickness of the bundle of folded sheets; and a spine formation unit disposed downstream from the sandwiching member in the sheet conveyance direction, to flatten the folded portion of the bundle of folded sheets held by the sandwiching member, the folded portion of the bundle of folded sheets projecting a predetermined length from the sandwiching member in the sheet conveyance direction, the spine formation unit pressing against the folded portion of the bundle of folded sheets in a reverse direction of the sheet conveyance direction while moving in a direction perpendicular to both the sheet conveyance direction and a longitudinal direction of the folded portion of the bundle of folded sheets.

13. A spine formation system comprising:

an image forming apparatus;

a post-processing apparatus to perform post processing of sheets transported from the image forming apparatus; and a spine formation device to flatten a folded portion of a bundle of folded sheets, the spine formation device comprising:

a sheet conveyer that conveys the bundle of folded sheets with a folded portion of the bundle of folded sheets forming a front end portion of the bundle of folded sheets;

a sandwiching member disposed downstream from the sheet conveyer in a sheet conveyance direction in which the sheet conveyer conveys the bundle of folded sheets, the sandwiching member to sandwich and squeeze the bundle of folded sheets, in a direction of thickness of the bundle of folded sheets; and a spine formation unit disposed downstream from the sandwiching member in the sheet conveyance direction, to flatten the folded portion of the bundle of folded sheets held by the sandwiching member, the folded portion of the bundle of folded sheets projecting a predetermined length from the sandwiching member in the sheet conveyance direction, the spine formation unit pressing against the folded portion of the bundle of folded sheets in a reverse direction of the sheet conveyance direction while moving in a direction perpendicular to both the sheet conveyance direction and a longitudinal direction of the folded portion of the bundle of folded sheets.

* * * * *